US006030181A

United States Patent [19]

Conrad

[11] Patent Number: 6,030,181

[45] Date of Patent: Feb. 29, 2000

[54] VACUUM APPARATUS AND A METHOD OF CONTROLLING A SUCTION SPEED THEREOF

[75] Inventor: Armin Conrad, Herborn, Germany

[73] Assignee: Pfeiffer Vacuum GmbH, Asslar, Germany

[21] Appl. No.: 09/018,888

[22] Filed: Feb. 5, 1998

[30] Foreign Application Priority Data

Feb. 5, 1997 [DE] Germany ..... 197 04 234

[51] Int. Cl.[7] ..... F04B 19/24

[52] U.S. Cl. ..... 417/53; 417/251; 417/440

[58] Field of Search ..... 417/53, 251, 440

[56] References Cited

U.S. PATENT DOCUMENTS 4,850,806 7/1989 Morgan et al. ..... 417/53

FOREIGN PATENT DOCUMENTS

| | | |
|---|---|---|
| 204163 | 7/1959 | Australia . |
| 0344345 | 12/1989 | European Pat. Off. . |
| 0401741 | 12/1990 | European Pat. Off. . |
| 230614 | 12/1985 | German Dem. Rep. . |
| 236967 | 3/1989 | German Dem. Rep. . |
| 4331589 | 6/1994 | Germany . |
| 4410903 | 10/1995 | Germany . |

*Primary Examiner*—Teresa Walberg
*Assistant Examiner*—Vinod D Patel
*Attorney, Agent, or Firm*—Brown & Wood, LLP

[57] ABSTRACT

A vacuum apparatus including at least one vacuum pump having at least one stage and high-vacuum and fore vacuum connections, and a connection line communicating a point located between the high vacuum and fore vacuum connections with the high vacuum connection; and a method for controlling a suction speed of the at least one vacuum pump.

5 Claims, 1 Drawing Sheet

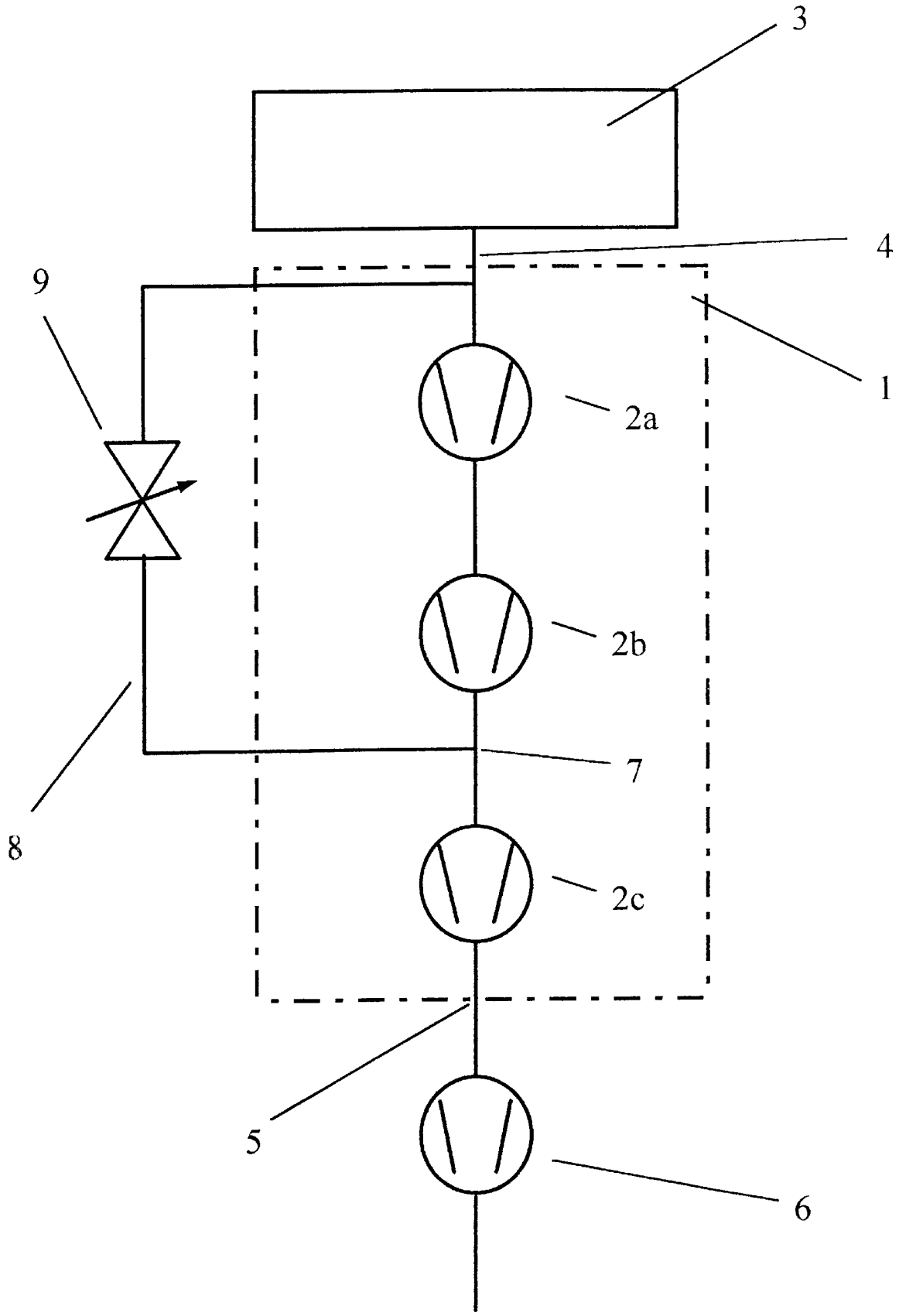
3
4
9
1
2a
2b
7
8
2c
5
6

VACUUM APPARATUS AND A METHOD OF CONTROLLING A SUCTION SPEED THEREOF

BACKGROUND OF THE INVENTION

1. Field of the Invention

The present invention relates to a vacuum apparatus including a vacuum pump having at least one stage, and a high vacuum junction and a fore vacuum junction arranged on opposite sides of the at least one stage, with gas flowing from the high vacuum junction to the fore vacuum junction, and a method of controlling the suction speed of the vacuum pump.

2. Description of the Prior Art

In apparatuses used for effecting vacuum processes, e.g., chemical processes or processes used in manufacturing of semi-conductors, a large conductance should be available between a vacuum chamber, in which a process is effected, and a vacuum pump which adjoins the vacuum chamber, to provide for rapid pumping-out of gaseous by-products. On the other hand, the adjustment and maintenance of a predetermined pressure of a gas or a gas mixture, at which the process is conducted, requires a definite and reproducible suction speed of the vacuum pump.

In conventional apparatuses, control valves, which are provided between the vacuum chamber and the vacuum pump, are used for controlling the suction speed of the vacuum pump. Because of the required large conductance, the control valves usually have large diameters. This leads to an expensive construction with high costs of manufacturing and also to a large volumetric expansion of its elements. In addition, these control valves need to meet particular requirements, resulting from their use in the high vacuum region.

Another possibility of controlling the suction speed at the high vacuum side becomes available when rotary vacuum pumps are used for pumping gas out of a vacuum chamber. In these pumps, the suction speed can be controlled by controlling the rotational speed of the rotary vacuum pump. The drawback of this solution consists in that the control is relatively slow and does not adequately respond to changes of the pressure in the vacuum chamber Further, the control of the suction speed at the high vacuum side should be coordinated with a corresponding control of the fore vacuum pressure which should be effected in a simple manner. The necessity to coordinate the control of the suction speed at the high vacuum side with the control of the fore vacuum fore vacuum pressure makes the achievement of a definite reproducible adjustment of the required relationships at the high vacuum side difficult because the control of the suction speed should be very steep, i.e., small adjustments at the fore vacuum side require big changes at the high vacuum side. Besides, because of a high pressure at the fore vacuum side, condensation and, in case of use of aggressive process gases, corrosion, which occur in the control valves, limit their use.

Accordingly, an object of the present invention is to provide a vacuum apparatus and a method of controlling its suction speed which would eliminate the drawbacks of the prior art apparatuses and methods.

Another object of the present invention is to provide a vacuum apparatus and a method which would insure a simple and reproducible adjustment of the suction speed and would permit to adapt the suction speed to requirements of a particular vacuum process.

A further object of the present invention is to provide an apparatus having inexpensive construction and in which condensation and corrosion are prevented.

SUMMARY OF THE INVENTION

These and other objects of the present invention, which will become apparent hereinafter, are achieved by providing a vacuum apparatus including a conduit which communicates a point between the high vacuum and fore vacuum junctions with the high vacuum junction for diverting a portion of gas flow back to the high vacuum junction, whereby the suction speed at the high side of the pump can be controlled.

The present invention permits to so influence the process, which takes place in the vacuum chamber, that it can be conducted in an optimal predetermined manner. Thus, e.g., when a constant suction speed of the vacuum pump or the vacuum system results in pumping out of too much gas, the process cannot be conducted in a predetermined manner. To adjust the suction speed, a portion of the gas flow is returned to the suction flange, i.e., to the high vacuum side. This results in increased pressure at the high vacuum side of the pump which causes reduction in the suction speed with which the process gas is pumped out of the vacuum chamber. Providing in the conduit, which communicates a portion of the gas flow back to the high vacuum junction of the vacuum pump, a control valve permits to precisely control the amount of gas flow through the conduit and, thereby, the change of pressure at the high vacuum side. The precise control of the pressure at the high vacuum side results in a precise control of the suction speed.

Turbomolecular pumps are particularly suitable for use as high vacuum pumps in vacuum processes. Using a turbomolecular pump as a high vacuum pump permits to effectively control the suction speed according to the present invention.

The present invention permits to eliminate the arrangement of expensive control valves on the suction flange for controlling the suction speed. Further, a direct control of the suction speed is provided, without a need in a slow control of a rotational speed of a rotary vacuum pump. Because the branching of the gas flow is effected from a point located upstream of the fore vacuum flange, the danger of condensation and/or corrosion is reduced to a large extent.

Further, communication of a portion of the gas flow back to the high vacuum side positively influences the composition of the process gases. Because the conductance in the connection conduit is higher for gases with a small molecular weight than for gases with a large molecular weight, the invention favors the use of lighter gases in the vacuum chamber. Gases with a small molecular weight are particularly favored for use in vacuum chambers. Heavy gases produce more waste products. Thus, the present invention insures an effective use of gases favorable for processes conducted in vacuum chambers.

BRIEF DESCRIPTION OF THE DRAWINGS

The features and objects of the present invention will become more apparent, and in the invention itself will be best understood from the following detailed description of the preferred embodiment when read with reference to the accompanying drawings, wherein:

Single FIGURE shows a schematic view of an apparatus according to the present invention for controlling a suction speed of a vacuum pump.

DETAILED DESCRIPTION OF THE PREFERRED EMBODIMENT

A vacuum pump 1, which is shown in the drawing, has three stages 2*a*, 2*b*, 2*c*. In the case when the last stage 2*c* does not attain a discharge pressure substantially equal to the atmospheric pressure, there is provided an additional, fore vacuum pump 6 which is connected to the fore vacuum junction 5 of the last stage 2*c*. A vacuum chamber 3 is connected to the high vacuum junction 4 of the first stage 2*a*. A connection conduit 8 connects a point 7 located between the fore vacuum junction 5 and the high vacuum junction 4. A control valve 9 is arranged in the connection conduit 8. The three stages 2*a*, 2*b*, 2*c* of the vacuum apparatus can be formed by three different pumps. The vacuum apparatus system can also be formed by a two-stage pump with stages 2*a* and 2*b* and a separate pump 2*c*. Such an apparatus would correspond to a structure of the pump 1 shown in FIG. 1.

The apparatus according to the present invention provides for return of a portion of gas flow, which is generated in the vacuum apparatus, through the connection conduit 8 and the control valve 9 back to the high vacuum junction 4 in a controlled manner. Thereby, the pressure at the suction side of the apparatus or pump 1 increases, resulting in a corresponding reduction of the suction speed of the gas pumped out from the vacuum chamber 3.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A method of controlling a suction speed of a vacuum pump, comprising the steps of:

providing a vacuum pump having at least one stage, a high vacuum junction located upstream of the at least one stage, and a fore vacuum junction located downstream of the at least one stage, with gas flowing from the high vacuum junction to the fore vacuum junction; and diverting a portion of gas flow from a point, which is located downstream of the at least one stage and upstream of the fore vacuum junction, back to the high vacuum junction.

2. A method as set forth in claim 1, further comprising the step of providing a control valve in a conduit connecting the point between the at least one stage and fore vacuum junction with the high vacuum junction for controlling gas flow through the conduit.

3. A vacuum apparatus, comprising:

at least one vacuum pump having at least one stage, a high vacuum junction located upstream of the at least one stage, and a fore vacuum junction located downstream of the at least one stage, with gas flowing from the high vacuum junction to the fore vacuum junction; and a conduit communicating a point, which is located downstream of the at least one stage and upstream of the fore vacuum junction, with the high vacuum junction for diverting a portion of gas flow from the point between the at least one stage and the fore vacuum junction to the high vacuum function.

4. A vacuum apparatus as set forth in claim 7, further comprising a control valve located in the connecting line for controlling gas flow therethrough.

5. A vacuum apparatus as set forth in claim 7, wherein the at least one stage is formed as a turbo-molecular pump.

* * * * *